United States Patent [19]

Anderssen

[11] Patent Number: 4,658,474

[45] Date of Patent: Apr. 21, 1987

[54] SWING WINDOW ARRANGEMENTS

[75] Inventor: Bjorn Anderssen, Vatne, Norway

[73] Assignee: Kva. Spil Ltd., Spjelkavik, Norway

[21] Appl. No.: 820,980

[22] Filed: Jan. 21, 1986

[30] Foreign Application Priority Data

Jan. 22, 1985 [NO] Norway ..... 850252

[51] Int. Cl.[4] ..... E05D 11/10

[52] U.S. Cl. ..... 16/352; 16/360; 16/388; 49/394

[58] Field of Search ..... 16/352, 388, 346, 349, 16/360, 371; 49/208, 26, 382, 391, 394

[56] References Cited

U.S. PATENT DOCUMENTS

| | | | |
|---|---|---|---|
| 536,333 | 3/1895 | Gail | 49/394 |
| 819,131 | 5/1906 | Ericson | 49/394 |
| 1,159,604 | 11/1915 | Soule et al. | 49/394 |
| 2,997,754 | 8/1961 | Walden | 49/394 |
| 3,305,971 | 2/1967 | Colen | 49/394 |
| 3,444,648 | 5/1969 | Anderson et al. | 49/394 |

*Primary Examiner*—Nicholas P. Godici
*Assistant Examiner*—Karen Skillman
*Attorney, Agent, or Firm*—Kenyon & Kenyon

[57] ABSTRACT

Swing window arrangement equipped with a child safety device and having a pair of pivot mountings (12) which are each provided with a frame fastening plate (13) which supports, about a first pivot pin (15), a first, upper pivot arm (16) and, about a second, lower pivot pin (17), a second, lower pivot arm (18), at a certain distance from each other. The child safety device is only arranged on the one pivot mounting. A first component (23) of the child safety device, which forms a weight-loaded drop bolt, is arranged axially moveable on the frame fastening plate (13). A second component (24) of the child safety device, which is provided with a stop forming hook (**24*a*), is fastened to the lower pivot arm (18) in order to be swung together with the latter and by this means is moved inwards into and outwards from a locking engagement with the first component (23). The first component (23) has the one end displaceably mounted on a first slide pin (26) in extension of pivot pin (15) of the first pivot arm (16) and the other end displaceably mounted on a second slide pin (28) which is fastened to the frame fastening plate (13) between the first pivot pin (15) and the second pivot pin (17). The second component (24) engages with the first component (23) in a region which lies substantially closer to pivot pin (15) of the first pivot arm (16) than pivot pin (17) of the second pivot arm (18**).

11 Claims, 4 Drawing Figures

SWING WINDOW ARRANGEMENTS

This invention relates to swing window arrangements equipped with child safety devices.

A concern of the present invention is especially, but not exclusively, the applicability of such arrangements to swing windows which have moderate or relatively small height dimensions, relatively small pivot mountings associated therewith and a corresponding limited space for locating the child safety device. These arrangements can, however, also be used with advantage for windows with larger heights. In other words, the aim is a child safety device which, in spite of the fact that it requires little space, nevertheless gives effective security and correspondingly, when this is desired, gives precise release of the device by a specially concentrated actuation of the latter. In addition, the objective is a child safety device which can be arranged in a usefully favorable location so that the device cannot be released unintentionally but, at the same time, can be allowed to be suspended without requiring great release force.

Accordingly, the present invention resides in a swing window arrangement including a window frame and a window casement connected to opposite sides of the window frame via a pair of pivot mountings each of which comprises a plate fastened to the window frame and upper and lower pivot arms supported on the plate about respective upper and lower pivot pins. In addition, a child safety device is incorporated in at least one of the pivot mountings and comprises a drop bolt first component arranged for axial movement on the pivot mounting plate and a second component having a stop-forming hook portion associated with the lower pivot arm enabling said hook portion to be swung with the pivot arm into and out of locking engagement with the first component at a location substantially closer to the upper pivot pin then to the lower pivot pin. One end of first component is displaceably mounted on a first slide pin forming an extension of the upper pivot pin while the other end is displaceably mounted on a second slide pin fastened to the plate between the first and second pivot pins.

It is now possible, even for window mountings of moderate or small size, to be able to place the child safety device in a favorable manner relative to the pivot pins of the pivot arms so that the device does not require unnecessary space. At the same time, an especially favorable positioning of the safety device is achieved so that unintentional release of this can be prevented. Furthermore, there is ensured an especially precise and effective engagement between the first and second components thereof during use. The last-mentioned advantage can be utilized independently of the size of the window mounting.

Figure 1:
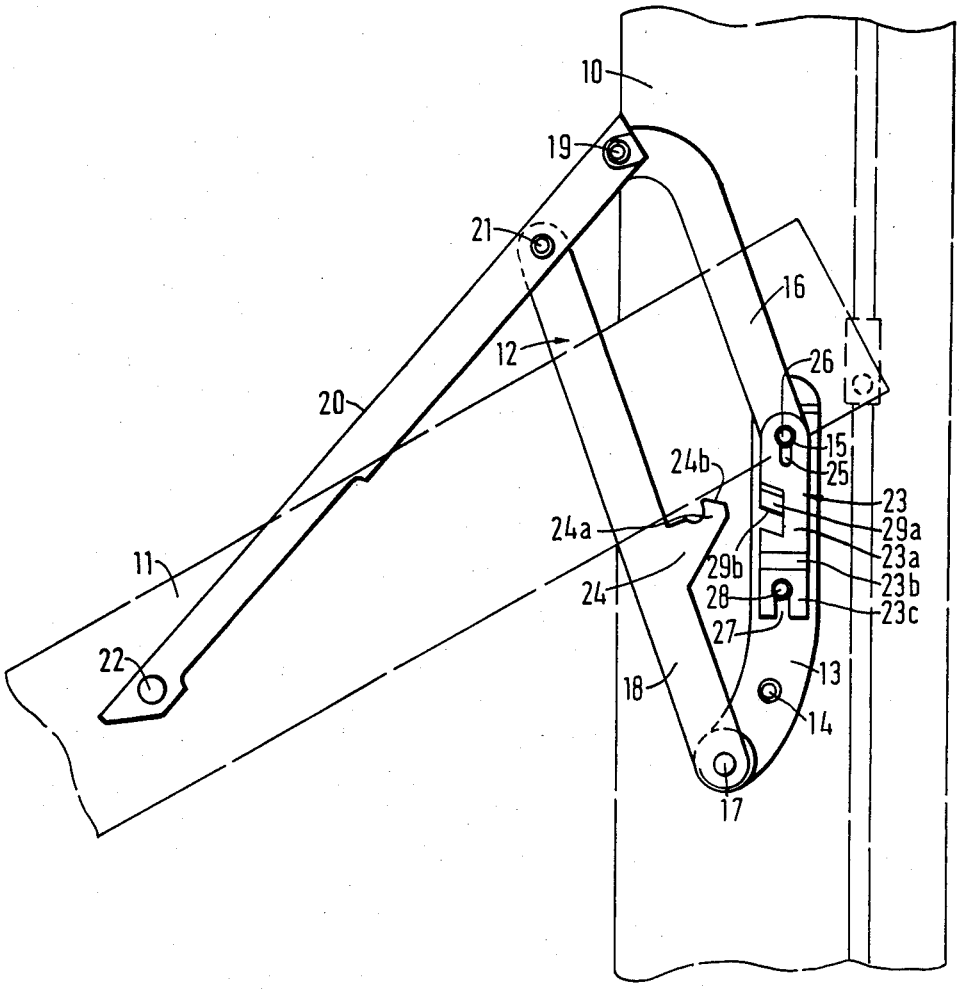
Figure 2:
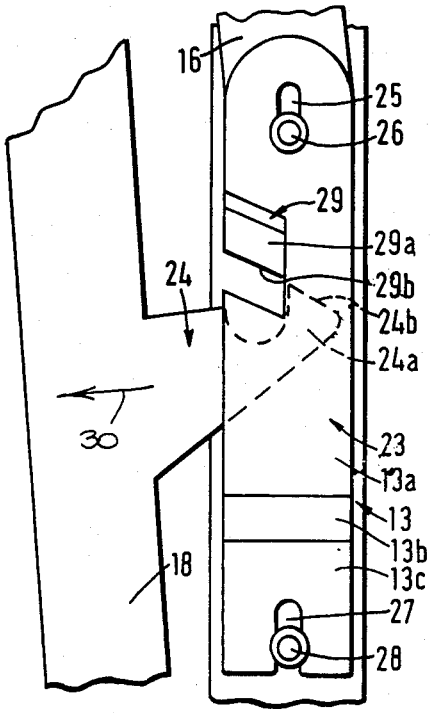
Figure 3:
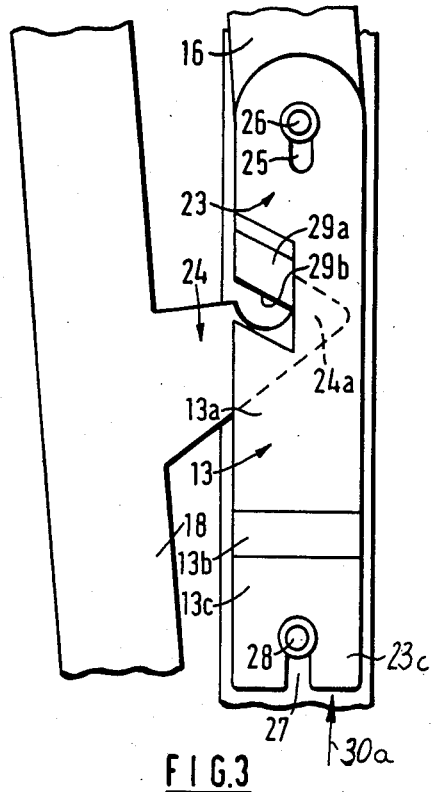
Figure 4:
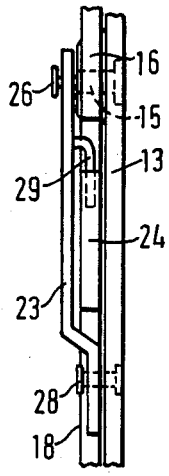

In order that the invention can be more clearly understood, a convenient embodiment thereof will now be described, by way of example, with reference to the accompanying drawings in which:

FIG. 1 is a schematic representation of a swing window arrangement showing a pivot mounting viewed in a direction towards one side of the window frame with the child safety components released relative to each other, FIG. 2 is a fragmentary side view showing on an enlarged scale the child safety components after their engagement is suspended, FIG. 3 is a similar view to FIG. 2 showing the child safety components in engagement with each other, and FIG. 4 is a fragmentary vertical end view of part of the pivot mounting with the child safety components in the position shown in FIG. 3.

Referring to FIG. 1, parts of a window frame 10 and parts of a window casement 11 are shown in broken lines. The window casement 11 is connected to the window frame 10 on two opposite sides of the window frame in a corresponding manner by means of a pivot mounting 12.

The pivot mounting 12 comprises a frame fastening plate 13 which is secured with fixing screws 14 to the window frame 10. To the plate 13 there are fastened a first pivot pin 15 for one end of a first, upper pivot arm 16 and a second pivot pin 17 for a corresponding one end of a second lower pivot arm 18. The opposite end of the pivot arm 16 is hingedly connected, via a pivot pin 19, to one, upper end of a support arm 20 while the corresponding opposite end of the pivot arm 18 is hingedly connected, via a pivot pin 21, to the support arm 20 at a suitable distance from the pivot pin 19. At the opposite, lower end of the support arm, the window casement 11 is pivotably mounted about a pin 22.

On opening the window, the pivot arms are swung about from a squeezed together position, through a child safety ventilation position (see FIGS. 2–4), towards the position illustrated in FIG. 1. In the child safety ventilation position, the pivot arms 16 and 18 are swung about only some few degrees from a closed starting position and, in this position, the window casement 11 covers large parts of the pivot mounting as is indicated by broken lines 11 in FIG. 1.

A child safety device consists of two cooperating components 23 and 24. A first component 23, which forms a weight-loading drop bolt and which constitutes the release component of the child safety device, is fastened, in part, to the frame fastening plate 13 and, in part, to pivot pin 15 of the first pivot arm 16. The second component 24, which forms the stop component itself and which is provided with a hook portion **24*a* at the outer end, is rigidly connected to the second pivot arm 18** and projects laterally outwards from the latter on the one side edge which faces inwardly towards the window.

The first component 23 is designed of flat steel which is bent into an elongate S-shaped loop form. The component 23 is provided with an elongate main portion **23*a*, an obliquely extending transition portion 23*b* and a lug-shaped portion 23*c* which runs parallel to the main portion 23*a*. In one, upper outer end of the main portion 23*a*, there is designed a slot 25 in the longitudinal direction of the component 23 and in the slot 25, there is received a slide pin 26 which projects endways outwards from pivot pin 15 of the pivot arm 16. In the lug portion 23*c*, there is designed a corresponding slot 27 in the longitudinal direction of the component 23. In the slot 27, there is received a slide pin 28 which is secured to the frame fastening plate 13 approximately centrally between the pivot pins 15 and 17. At one side portion of the component 23, there is bent a bolt member 29 which projects laterally outwards from and is deflected with a stop-forming flap 29*a* parallel to the main portion 23*a*. The bolt member 29 with the flap 29*a* forms a stop for hook portion 24*a* of the component 24 as illustrated in FIGS. 2 and 4. By means of a finger grip as indicated by the arrow 30*a* in FIG. 3, the drop bolt-forming component 23 can be axially disposed, that is to say raised from the locking position in FIG. 3 to the released position in FIG. 3. By exerting, thereafter, a pushing force in the direction of the arrow 30, the child safety device can be raised and the window can be opened further outwards from the position shown in FIG. 1** in the usually known manner.

The leading upper edge 24*b* of the hook portion 24*a* runs obliquely relative to the direction of movement of the hook portion and the corresponding lower edge 29*b* of the flap 29*a* runs correspondingly obliquely. On swinging component 24 from the position shown in FIG. 1 to the position shown in FIG. 2, the drop bolt component 23 is raised upwards, as shown in FIG. 2, in order, thereafter, to drop into place in the locking position, as shown in FIG. 3, by means of the weight of the drop bolt 23.

Provision is made for the bolt member 29 to be placed in the pivotal path of the hook portion 24*a*. This pivotal path is defined between the inner side of the drop bolt or the loop component 23 and the outer side of the fastening plate 13. Provision is made for the hook portion 24*a* to have a greater thickness than the bolt member so that the bolt member 29 forms a support against a region between main side surfaces of the hook portion, as is shown in FIG. 4.

In the illustrated embodiment there is achieved a reliable control of the hook portion 24*a* relative to the bolt member 29 and a reliable engagement between the hook portion 24*a* and the bolt member 29. At the same time, there is obtained, from the actuation viewpoint a favorable placing of the child safety components 23, 24 relative to the fastening plate 13, since the bolt member can be arranged relatively tightly up to the adjacent end portion of the pivot arm 16, with a correspondingly reliable fastening for the component 23 and with a correspondingly screened and sheltered placing of the release component 23 of the child safety device.

I claim:

1. Swing window arrangement comprising:

(a) a window frame;

(b) a window casement connected to opposite sides of said window frame via a pair of pivot mountings each of which comprises a plate fastened to said window frame, said plate supporting upper and lower pivot arms about respective upper and lower pivot pins; and (c) a child safety device incorporated in at least one of said pivot mountings and comprising a drop bolt first component arranged for axial movement on said pivot mounting plate and a second component having a stop-forming hook portion associated with said lower pivot arm enabing said hook portion to be swung with said pivot arm into and out of locking engagement with said first component at a location substantially closer to said upper pivot pin than to said lower pivot pin, one end of said first component being displaceably mounted on a first slide pin forming an extension of said upper pivot pin while its other end is displaceably mounted on a second slide pin fastened to said plate between said first and second pivot pins.

2. The arrangement of claim 1, wherein the first component is a strip member defining with the plate a space for receiving the second component and having a bolt portion bent inwardly into said space which is adapted to drop into locking engagement with the hook portion in a plane centrally between said strip member and said plate from a release position to which said bolt portion is lifted by said hook portion with inward swinging of the lower pivot arm.

3. The arrangement of claim 2 wherein the strip member has a generally elongate, S-shaped cross-section and is formed with upper and lower longitudinal slots receiving the first and second slide pins respectively to permit the axial movement of said strip member relative to the plate.

4. The arrangement of claim 1, wherein the second component is rigidly connected to the lower pivot arm and projects laterally outwards from the latter in the direction of the window frame with the hook portion at its outer end.

5. The arrangement of claim 1, wherein the at least one pivot mounting includes a support arm having the window casement pivotably mounted at its lower end while its upper end has upper ends of the pivot arms pivotably mounted at spaced apart locations thereon, the lower ends of said pivot arms being supported by the plate.

6. A swing window arrangement comprising a window frame;

a window casement;

at least one pivot mounting secured to and between said frame and said casement for movement of said casement between a closed position and an open position relative to said frame, said pivot mounting including a pivot pin, an upper arm pivotally mounted on said pivot pin and a lower arm mounted between said frame and said casement; and a safety device including a pair of components, a first of said components being slidably mounted about said pivot pin for movement between a rest position and a raised position, a second of said components being secured to said lower arm for releaseably engaging said first component in said rest position thereof to maintain said casement in a partially open position spaced from said closed position and for movement past said first component in said raised position thereof to permit movement of said casement to said open position thereof.

7. A swing window arrangement as set forth in claim 6 which further comprises a pin below said pivot pin and wherein said first component includes a slot receiving said pin.

8. A pivot mounting for a window casement comprising a plate;

a support arm for securement to a window casement;

a pivot pin secured to said plate;

a first arm pivotally mounted on said pivot pin and secured to said support arm;

a second arm pivotally connected to and between said plate and said support arm;

a drop bolt slidably mounted about said pivot pin for movement between a rest position and a raised position; and a stop secured to said second arm for releasably engaging said drop bolt in said rest position thereof to prevent said second arm from pivoting away from said plate and for movement past said drop bolt in said raised position thereof to permit pivoting of said second arm away from said plate.

9. A pivot mounting as set forth in claim 8 which further comprises a second pin on said plate between said arms and wherein said drop bolt includes a slot receiving said second pin therein.

10. A pivot mounting as set forth in claim 8 wherein said drop bolt is slidably mounted between said pivot pin and said second pin.

11. A pivot mounting as set forth in claim 8 wherein said drop bolt includes a flat main portion and a stop-forming flap deflected from said main portion and said stop on said second arm has a hook portion for engaging said flap.

* * * * *